US005653086A

United States Patent [19]

Spada et al.

[11] Patent Number: 5,653,086

[45] Date of Patent: Aug. 5, 1997

[54] PACKAGING MACHINE FOR DELICATE ROD-SHAPED OBJECTS, ESPECIALLY CIGARETTES OR THE LIKE

[75] Inventors: Valter Spada, Marzabotto; Gianfranco Isani, Caluso, both of Italy

[73] Assignee: SASIB S.p.A., Bologna, Italy

[21] Appl. No.: 571,341

[22] Filed: Dec. 12, 1995

[30] Foreign Application Priority Data

Dec. 14, 1994 [IT] Italy ..... GE94A0138

[51] Int. Cl.[6] ..... B65B 19/04

[52] U.S. Cl. ..... 53/148; 53/234; 131/283

[58] Field of Search ..... 131/282, 283; 53/148, 149, 150, 151, 225, 228, 233, 234

[56] References Cited

U.S. PATENT DOCUMENTS

| | | | |
|---|---|---|---|
| 2,397,190 | 3/1946 | Malhiot | 53/234 X |
| 2,603,047 | 7/1952 | Malhiot | 53/234 X |
| 3,055,490 | 9/1962 | Anderson et al. . | |
| 3,537,232 | 11/1970 | Mateyka et al. | 53/234 |
| 4,079,575 | 3/1978 | Focke et al. | 53/234 |
| 4,085,568 | 4/1978 | Focke et al. | 53/234 |
| 4,092,816 | 6/1978 | Seragnoli | 53/234 |
| 4,408,439 | 10/1983 | Anderson | 53/234 X |
| 5,022,213 | 6/1991 | Draghetti et al. | 53/234 |
| 5,085,028 | 2/1992 | Boriani et al. | 53/234 |

FOREIGN PATENT DOCUMENTS

| | | |
|---|---|---|
| 502249 | 3/1939 | United Kingdom . |
| 2231317 | 11/1990 | United Kingdom . |

*Primary Examiner*—Daniel Moon
*Attorney, Agent, or Firm*—Larson and Taylor

[57] ABSTRACT

A packaging machine for delicate rod-shaped objects, especially cigarettes or the like, is provided with at least one wheel (1, 5) for carrying, along a path between many operating units, a series of ordered groups of cigarettes. The wheel (1, 5) is provided with one or more peripheral sockets (105), each designed to accommodate one ordered group of cigarettes (S) and each being open on the peripheral side of the wheel and/or on at least one face (101, 201) of the wheel (1, 5). The wheel or wheels (1, 5) consist of a central hub part (1) and annular rims (5, 305) attached removably (4) to the periphery of the central hub (1). The rims (5, 305) are separated axially by a lesser distance than the axial dimension of the ordered groups of cigarettes (S) and form the accommodating sockets by means of supporting cradles (105) coinciding axially with each other and shaped to correspond with those parts of the ordered groups of cigarettes that coincide with the annular rims (5).

7 Claims, 2 Drawing Sheets

PACKAGING MACHINE FOR DELICATE ROD-SHAPED OBJECTS, ESPECIALLY CIGARETTES OR THE LIKE

BACKGROUND AND SUMMARY OF THE INVENTION

The invention relates to a packaging machine for delicate rod-shaped objects, especially cigarettes or the like, comprising at least one wheel for carrying, along a path between many operating units or stations, a series of ordered groups of cigarettes, which wheel is provided with one or more peripheral sockets, each designed to accommodate one ordered group of cigarettes and each being open on the peripheral side of the wheel and/or on at least one face of said wheel.

At present, especially in cigarette packaging machines, wheels with sockets are used for forming the inner foil wrapping and the packet, which may be soft or hard. The packets are formed by folding the foil wrapping, or the wrapping for the soft pack or the preformed blank for the hard pack, around the corresponding ordered group of cigarettes. The wrappers and blanks are folded by stationary folding means and movable folding means distributed in predetermined positions for each folding step around the periphery of a wheel which is mounted so as to rotate, in predetermined steps, about its axis and which accommodates the ordered groups of cigarettes in corresponding sockets complementary in shape to the cross section of the ordered group of cigarettes.

In order for packaging machines to achieve high productivity, the forming wheels have to rotate at very high speeds. The advancing steps must therefore be performed extremely quickly, which makes for real problems of inertia because of the continual accelerations and decelerations. It is advantageous, therefore, for the forming wheels to be constructed with extremely low mass.

In addition, since many different shapes of cigarette packets exist, it is also necessary to make the sockets of the forming wheels easily adaptable to the different dimensions of the ordered groups of cigarettes, without excessively complicating the construction, and increasing the weight, of the forming wheels.

The object of the invention is to provide a carrying wheel for packaging machines of the sort described at the outset whose construction is simple and inexpensive, as well as being very light and easily adaptable to the different shapes of packets, while at the same time guaranteeing the necessary robustness and mechanical strength.

The invention achieves the above objects in the form of a packaging machine of the sort described at the outset, in which the wheel or wheels for carrying the ordered groups of cigarettes consist of a central hub part, while around the peripheral sockets for accommodating the ordered groups of cigarettes said wheel is formed by annular rims attached removably to the periphery of the central hub, which rims are separated axially by a lesser distance than the dimension of the ordered group of cigarettes, in the axial direction of the wheel, and form the accommodating sockets by means of supporting cradles shaped to correspond with those parts of the ordered groups of cigarettes that coincide with said rims.

The ordered groups of cigarettes are preferably accommodated in the wheel with the axes of the cigarettes oriented approximately parallel with the axis of the wheel. If this arrangement is adopted, the socket parts of the annular rims will be shaped in such a way as to form cradles for accommodating the corresponding end parts of the ordered groups of cigarettes.

The annular rims may be made in the form of closed rings or divided into a plurality of separate segments forming, in combination with each other, an essentially continuous ring. Alternatively, the rims may be made up of a plurality of annular segments separated from each other and essentially extending only in the immediate vicinity of the sockets for accommodating the ordered groups of cigarettes.

The central hub is advantageously made of metallic material, such as light alloy and/or the like, whereas the annular rims or the annular segments which go to make these up are made of plastic material.

In an improvement, the annular rims, or the annular segments forming these, may comprise weight-reducing openings. Said weight-reducing openings are preferably produced in such a way as to form radial connecting ribs between the outer peripheral part and the inner peripheral part of the annular rims and/or of the segments forming these.

Another feature is that the supporting cradles forming the sockets for accommodating the ordered groups of cigarettes are formed by axial flanges or thickenings complementary in shape to the ordered group of cigarettes, these flanges or thickenings being situated on the opposing annular rims in axial alignment with each other. If an aperture is provided on the corresponding face of the wheel, the flanges and/or thickenings run around the edge of said aperture in the corresponding annular rim. If there is no aperture on the face of the wheel, the thickenings or flanges are made in the form of ribs of appropriate shape projecting axially from the inner face of the corresponding annular rim.

In particular, the sockets of the wheel according to the invention are open on both faces of the wheel and around the latter's periphery. If this arrangement is adopted, the annular rims comprise, in axially coinciding positions, recesses complementary in shape to the cross section of the group of cigarettes, said recesses being open around the outer periphery of said rims and the flanges or thickenings being situated around the edges of said recesses.

The recesses or cradles are of different shapes according to the different shapes of the packets and hence of the ordered groups of cigarettes. Advantageously, for easy adaptation of the forming wheel to the packet, different types of annular rims are provided, all having the same internal diameter and the same external diameter, the difference between the internal and the external diameters being determined by the shape of whichever socket is radially the longest.

The advantages of the invention will be clear from the above account. The composite structure of the forming wheels enables both its cost of manufacture and its inertial mass to be greatly reduced. It also permits easy and rapid adaptation of the packaging machine to the different shapes of packet envisaged. Moreover, these advantages are achieved in a simple and inexpensive construction which still meets the requisite characteristics of mechanical strength.

BRIEF DESCRIPTION OF THE DRAWINGS

The invention also relates to other features which further improve the packaging machine described above and these form the subject of the dependent claims.

The special features of the invention and the advantages that flow therefrom will appear in greater detail in the following description of certain preferred embodiments illustrated by way of non-restricting example in the accompanying drawings, in which.

DESCRIPTION OF THE PREFERRED EMBODIMENT OF THE INVENTION

Figure 2:
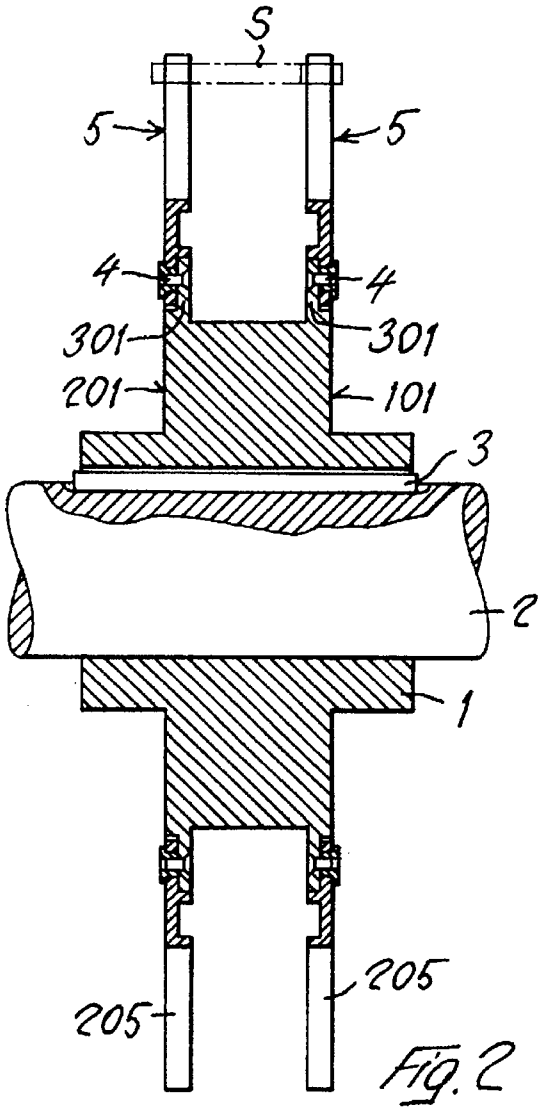
FIG. 2 is an axial section through the wheel of FIG. 1.
Figure 1:
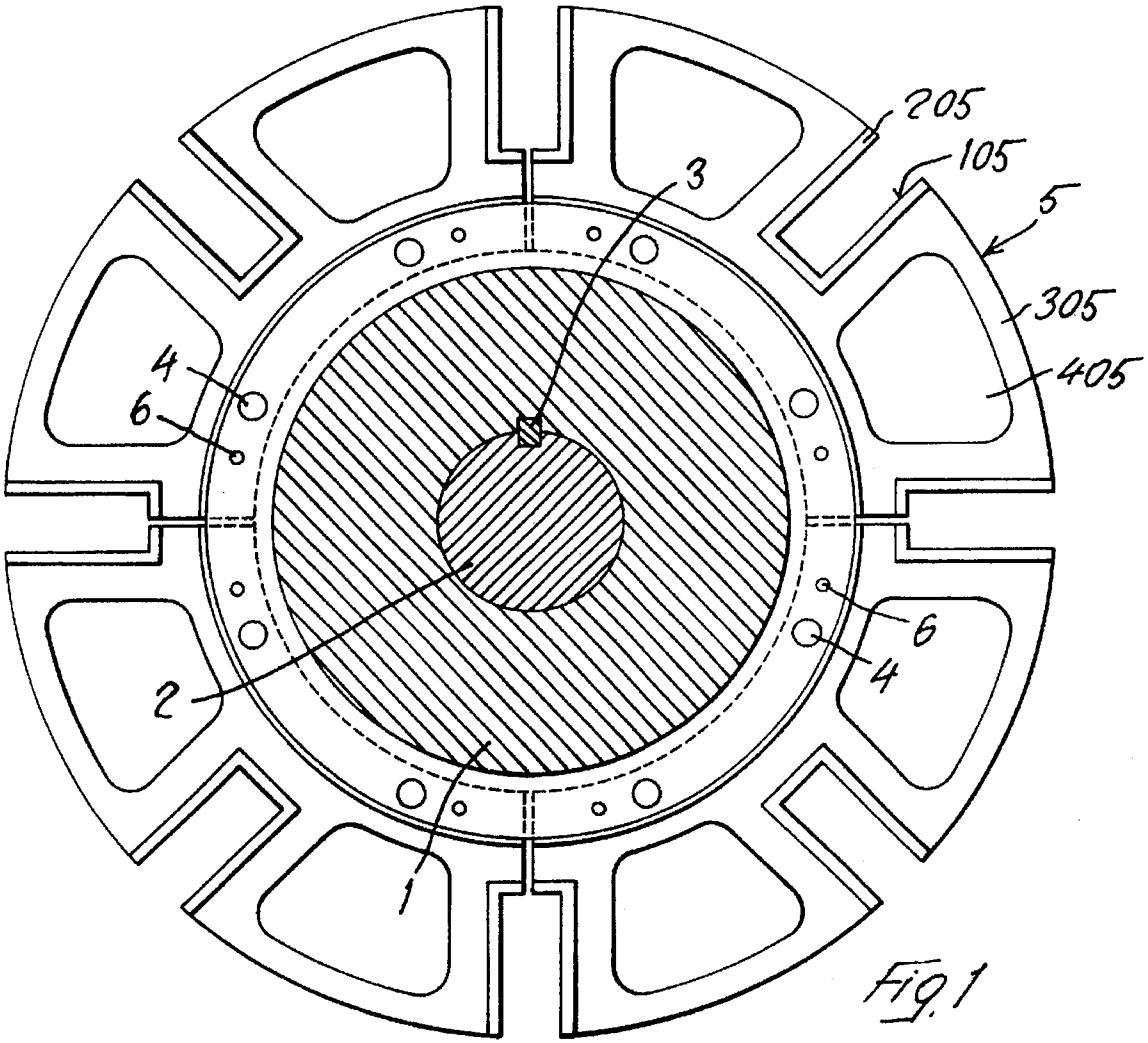
FIG. 1 is a front view of the wheel for the packaging machine according to the invention.

With reference to FIGS. 1 and 2, a wheel for a packaging machine, especially for cigarettes, as for example a wheel for forming the foil wrapping around an ordered group of cigarettes or for forming the soft pack or hard pack, likewise around the ordered group of cigarettes, optionally after the latter has been wrapped in the foil wrapping, comprises a central hub 1 which is attached to a drive shaft 2, in such a way as to be rotated with it by means of a radial key 3. On the two opposite faces 101 and 201 of the wheel, the hub 1 has two annular ribs 301 to which annular rims 5 are attached removably, for example by means of screws or the like 4. The central hub 1 is made of metallic material, preferably light alloy, whereas the annular rims 5 are made of plastic material with appropriate mechanical strength characteristics.

The annular rims 5 are aligned flush with at least the outer faces 101, 201 of the central hub 1 and the annular ribs 301 are separated axially by a lesser distance than the axial length of the cigarettes S. The annular rims 5 are attached at two points circumferentially distant from each other, while at an additional two points circumferentially distant from each other, the rims 5 and the annular ribs 301 are provided with complementary centering means, as for example pins and axial coinciding holes indicated generally by the numeral 6. Recesses 105 are formed in positions that coincide axially with each other in the opposite annular rims 5. The recesses 105 are rectangular in shape and are oriented in the radial direction of the wheel, being open on the outer peripheral edge of the annular rims 5. Each pair of axially coinciding recesses 105 forms a pair of cradles for the corresponding end parts of the cigarettes of an ordered groups of cigarettes. The shape of the recesses 105 is complementary or approximately complementary with the cross section of the ordered groups of cigarettes. Consequently the annular rims 5 form, with the recesses 105, radial accommodating sockets open on both faces of the wheel and around its periphery for the ordered groups of cigarettes.

Advantageously, around the peripheral edges of the recesses 105 in the annular rims 5 is an axial flange or thickening 205 of said edges, which slightly increases the surface for supporting the cigarettes of each ordered group.

Each annular rim 5 may comprise a plurality of recesses 105 arranged at equal angular distances, and in addition each annular rim 5 may be made up of a plurality of annular segments 305 which combine to form a closed annular shape. In particular, in FIG. 1, the annular rims 5 are divided into four annular segments with an angular width of 90°. Furthermore, using eight equidistant sockets, the lines of separation between one segment 305 and the next are situated along the central radial axis of a recess 105 which is consequently half formed by a segment 305 and half formed by the next segment, while each segment 305 has one recess 105 in its center. In the parts of the annular segments 305 situated between the peripheral recesses and the intermediate recess there are weight-reducing openings 405 which are formed in such a way as to leave only radial bridges connecting the outer peripheral edge with the inner peripheral edge next to the recesses 105.

Other geometrical distributions of the recesses are also possible, of course, according to their number and size and to the manner in which the wheel itself is to operate.

Figure 3:
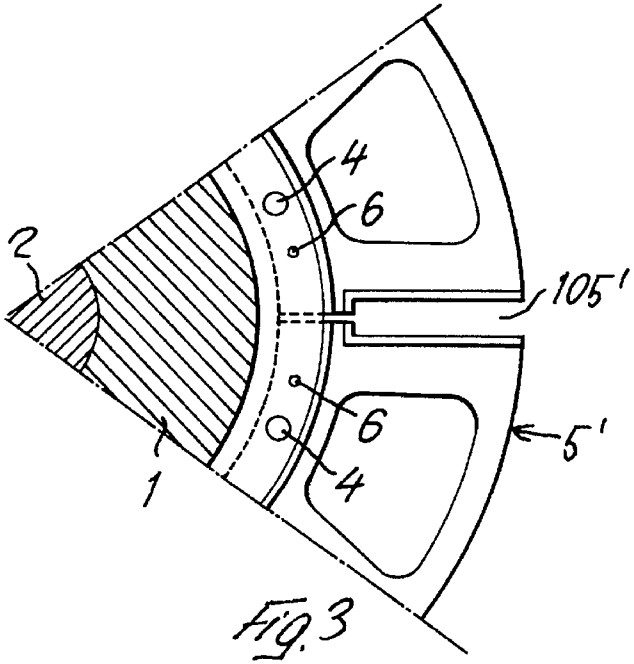
FIGS. 3 to 5 show various alternative embodiments of the accommodating cells for forming packets of cigarettes of different dimensions.
Figure 4:
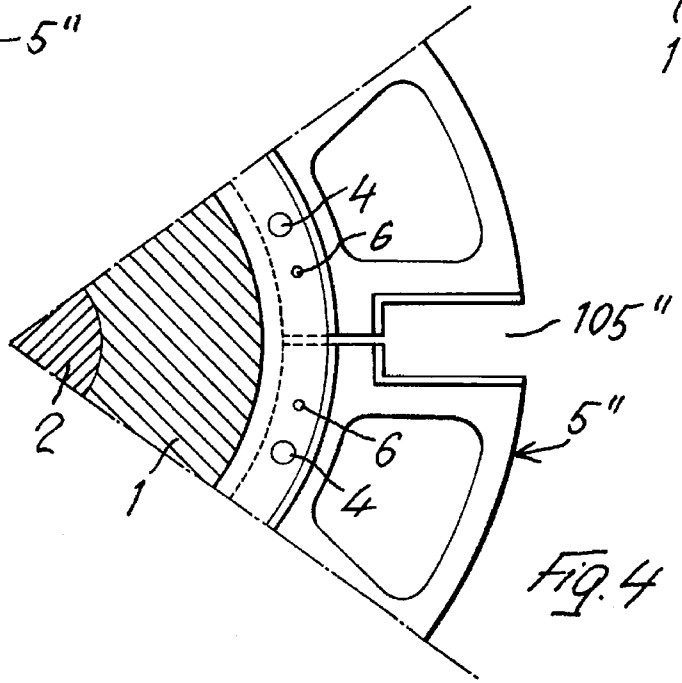
Figure 5:
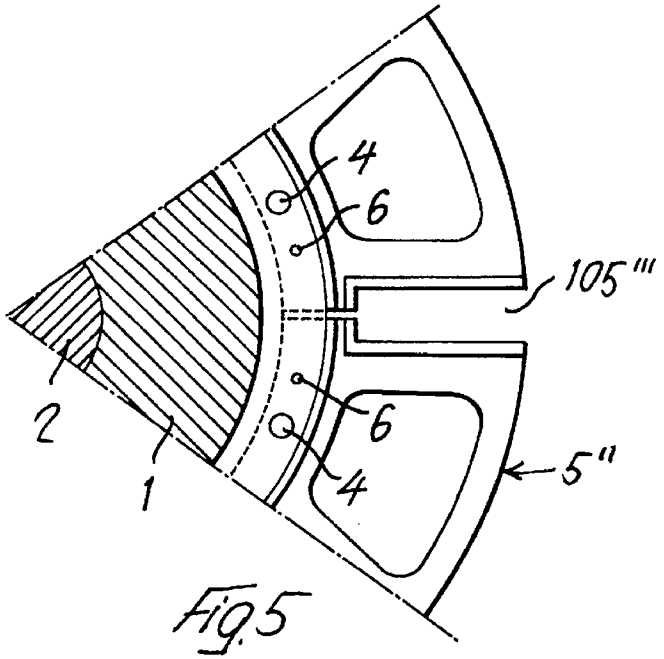

Constructing the wheel in accordance with the above account makes it a very simple matter to adapt the wheel to different shapes of cigarette packets and hence to the different shapes of the ordered groups of cigarettes being packaged. With particular reference to the cross section of the packet, i.e. to the cross section of the group of cigarettes, the wheel is adapted simply by replacing the annular rims 5, with annular rims 5', 5", 5'" containing recesses 105', 105", 105'" of different dimensions as illustrated in FIGS. 3 to 5. If this is to be done, then in order to avoid also having to alter the positions of members such as, for example, folding members or the like interacting with the wheel, it is advantageous to construct all the annular rims 5, 5', 5", 5'" with the same internal diameter and the same external diameter, the difference between the two diameters being commensurate with the sockets, that is recesses 105' or 105'", that measure the most in the radial direction. It is obviously extremely simple and quick to adapt the wheel, since it is only necessary to act on two screws 4 for each annular segment 305 and since means of mutual centering 6 are provided between the annular segments 305 and the central hub 1.

In another improvement, which is not illustrated, the wheel according to the invention can also be adapted, if required, to cigarettes of different lengths. If this is to be done, the annular rims 5, or the annular segments 305, will be L-shaped in axial section and an axial distance ring will be provided at their inner diameter in the region of contact against the annular ribs 301 of the central hub 1. The distance ring may be made in one piece with the annular rims 5 or with the annular segments 305, or else may simply be axially insertable between the ribs 301 of the hub 1 and the radially innermost part of the rims 5 or of the segments 305 where they are attached to said ribs 301.

Clearly, the invention is not limited to the embodiments described above and illustrated, and can be greatly altered and modified, especially from the point of view of construction. For example, depending on the kind of socket required, the recesses 105 may even be closed around the outer peripheral edge and may be of any shape. Moreover, if the accommodating sockets require no apertures on one face of the wheel, no recess 105 will be provided in the corresponding annular rim 5 or segment 305, and the cradle for supporting the corresponding ends of the cigarettes may consist of a flange or thickening in the form of a rib projecting axially from the inner face of the rim 5 or segment 305 and corresponding in shape to the shape of the section of the ordered group of cigarettes and coinciding in position with a recess or a similar rib in the opposite rim or segment 5, 305. All of this may be done without abandoning the underlying principle set forth above and claimed below.

We claim:

1. A packaging machine for ordered groups of delicate rod-shaped objects comprising:

at least one wheel which carries individual ones of a series of the ordered groups of the objects along a path, said wheel comprising (a) a central hub defining a central longitudinal axis about which said wheel rotates, said hub having first and second end faces defining first and second radial planes separated by a distance which is less than a length dimension of the rod-shaped objects, an annular peripheral face between said first and second end faces, and first and second annular ribs extending radially outwards from said annular peripheral face adjacent but stepped back from the respective first and second planes, (b) first and second annular rims extending radially from said annular peripheral face of said central hub, each said annular rim having a thickness adjacent an associated one of the stepped back said first or second annular ribs so that a respective end surface of said annular rim is coincidental with the respective radial plane of an adjacent said first or second end face of said central hub, four discrete segments, each segment annularly forming one quarter of said annular rim so that said four discrete segments together form a complete said annular rim, and each said discrete segment having a central radial recess and a half radial recess at each annular end such that said central recess and adjacent half recesses of adjacent said discrete segments both form an annular socket sized to radially receive a cross section of a respective group of the objects;

(c) a centering means for annularly centering each respective said discrete segment on a predetermined portion of one of said first and second annular ribs whereby each respective said socket of said first annular rim is axially aligned with a respective said socket of said second annular rim so that aligned said sockets form a cradle for a group of the objects; and (d) a fastening means for removably fastening each respective said segment to the associated one of the stepped back said first and second annular ribs.

2. A packaging machine as claimed in claim 1 wherein said sockets are open axially in both directions and radially in an outward direction.

3. A packaging machine as claimed in claim 2 wherein each said central radial recess and half radial recess include group engaging flanges having an axial dimension greater than an axial dimension of the respective said segment.

4. A packaging machine as claimed in claim 1 wherein said central hub is made of a light-weight metallic material and said discrete segments are made of a plastics material.

5. A packaging machine as claimed in claim 1 wherein each said central radial recess and half radial recess include group engaging flanges having an axial dimension greater than an axial dimension of the respective said segment.

6. A packaging machine as claimed in claim 1 wherein each said segment includes therein axial openings which are closed radially so as to reduce a weight of said segment.

7. A packaging machine as claimed in claim 1 and further including third and fourth annular rims identical to the respective said first and second annular rims except for a size of said central radial recess and half radial recesses of each associated discrete segment so that said first and second annular rims are replaceable using said removable fastening means and said centering means with said third and fourth annular rims when a different cross sectional size of respective groups of objects is desired for carrying groups of objects along the path.

* * * * *